US005656982A

United States Patent [19]

Kurahara

[11] Patent Number: 5,656,982

[45] Date of Patent: Aug. 12, 1997

[54] PLUNGER-OPERATED ALARM SWITCH ASSEMBLY

[75] Inventor: Jon E. Kurahara, Sherwood, Oreg.

[73] Assignee: Sentrol, Inc., Tualatin, Oreg.

[21] Appl. No.: 513,362

[22] Filed: Aug. 10, 1995

[51] Int. Cl.[6] ..... H01H 9/00

[52] U.S. Cl. ..... 335/205; 335/206

[58] Field of Search ..... 335/205–7

[56] References Cited

U.S. PATENT DOCUMENTS

| | | | |
|---|---|---|---|
| 3,710,052 | 1/1973 | Jette, Jr. . | |
| 3,803,575 | 4/1974 | Gotanda . | |
| 3,851,325 | 11/1974 | Maged . | |
| 3,967,080 | 6/1976 | Errani . | |
| 4,317,969 | 3/1982 | Riegler et al. | 335/207 |
| 4,336,518 | 6/1982 | Holce et al. | 335/205 |
| 4,465,997 | 8/1984 | Hines . | |
| 4,587,517 | 5/1986 | Engstrom et al. . | |
| 4,609,910 | 9/1986 | Geringer et al. . | |
| 4,616,285 | 10/1986 | Sackett | 335/205 |
| 4,903,010 | 2/1990 | Greene . | |
| 5,155,460 | 10/1992 | Huckins et al. | 35/205 |

*Primary Examiner*—Lincoln Donovan
*Attorney, Agent, or Firm*—Stoel Rives LLP

[57] ABSTRACT

A plunger-operated alarm switch assembly (10) provides without visual inspection thereof an indication of whether a barrier (14) is in a secure position or whether the alarm switch assembly has been tampered with. A preferred embodiment includes a plunger housing (18) that is matable to a switch plate (20). The plunger housing supports a movable plunger (22) having a permanent magnet (24) that produces a magnetic field (26). The switch plate supports a magnetically actuatable reed switch (28) positioned in a predetermined relative alignment to a guide path (32) of the plunger when the plunger housing and the switch plate are matably fitted together. The plunger is movable relative to the plunger housing between alarm and secure positions so that whenever the plunger is in the alarm position, the reed switch provides an alarm switching condition; whenever the plunger is in the secure position, the reed switch provides a secure switching position; and whenever the predetermined relative alignment of the reed switch and the guide path of the plunger changes, the reed switch provides the alarm switching condition.

18 Claims, 6 Drawing Sheets

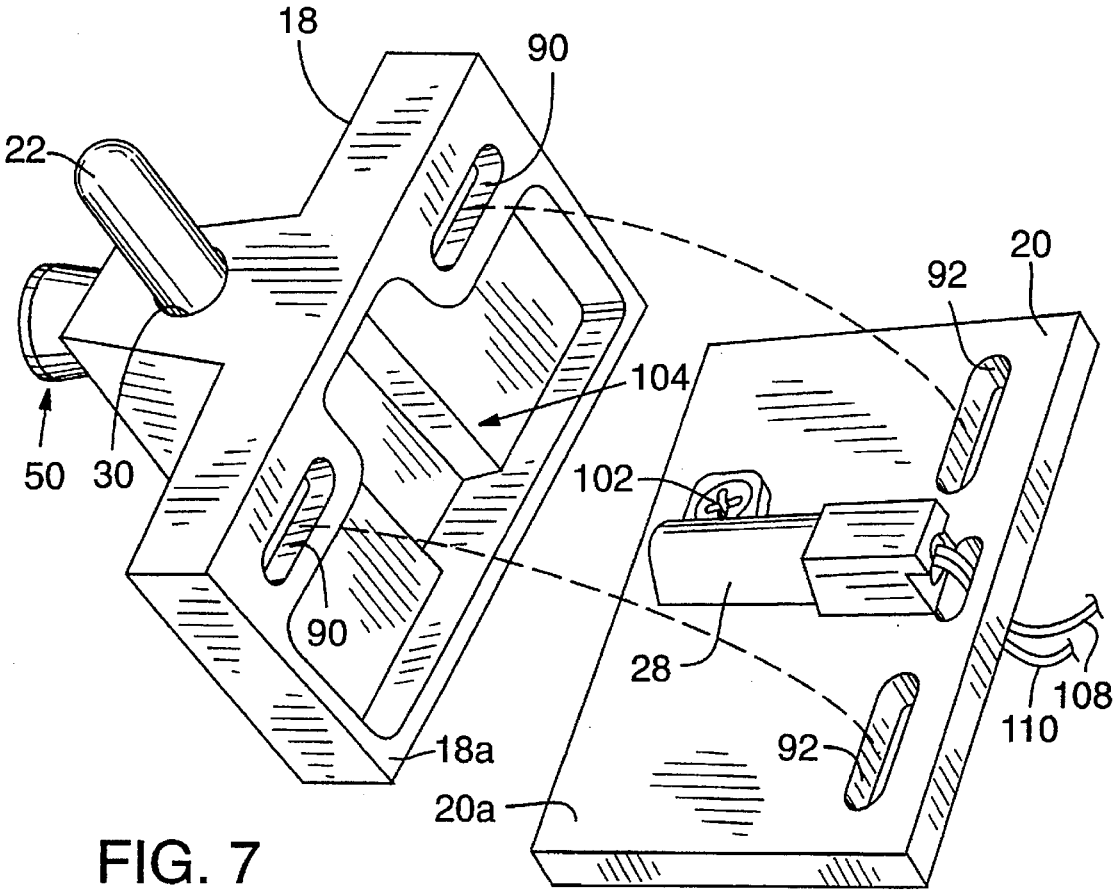
FIG. 7
FIG. 9
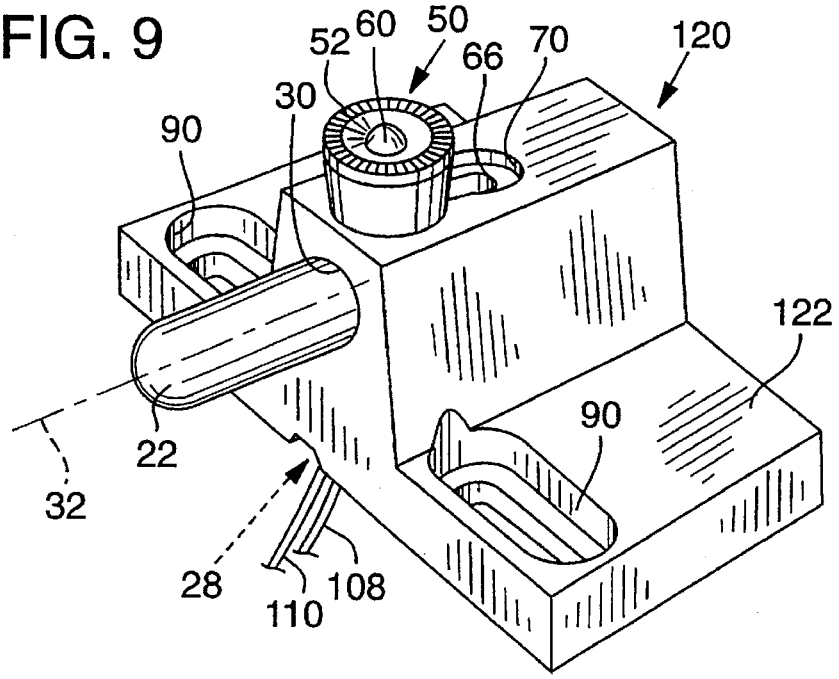

PLUNGER-OPERATED ALARM SWITCH ASSEMBLY

TECHNICAL FIELD

This invention relates to plunger-operated switch assemblies and, in particular, to a plunger-operated alarm switch assembly that provides without visual inspection of the alarm switch assembly an indication of whether a barrier is in a secure position or the alarm switch assembly has been tampered with.

BACKGROUND OF THE INVENTION

A conventional dead bolt secures a movable barrier, such as a patio door, in a closed position relative to a barrier frame, such as a patio door frame. To secure a patio door in the closed position, a user typically extends the dead bolt from a patio door frame-mounted dead bolt housing into an aligned aperture in the patio door thereby preventing movement of the patio door relative to the door frame.

These conventional dead bolts suffer from at least two disadvantages from a security awareness perspective. First, the dead bolt must be visually inspected to determine whether it is extended into and securely positioned within the aligned aperture. Second, the dead bolt assembly must be visually inspected to determine whether it has been tampered with, including removal of the dead bolt housing from the barrier frame or damage to the dead bolt itself, such as by removal of a portion of the dead bolt.

The dead bolt described in U.S. Pat. No. 3,803,575 to Gotanda is an attempt to solve the problem of providing without visual inspection an indication of whether a dead bolt is extended into and securely positioned in an aligned aperture. Gotanda describes a door-mounted dead bolt supporting a magnet and a door frame-mounted reed switch positioned adjacent an aperture that is aligned with and receives the extended dead bolt. The reed switch is activated into the "on" position by the magnet in the dead bolt, indicating a closed position of the door, when the dead bolt is extended into the aperture and the magnet is positioned adjacent the reed switch.

The Gotanda dead bolt suffers from at least two disadvantages. First, the Gotanda dead bolt requires installation of components on the door and on the door frame, resulting in expensive installation costs and possible future misalignment problems between the dead bolt and the reed switch. Second, the Gotanda dead bolt assembly must be visually inspected to determine whether it has been tampered with by removal of the reed switch from the door frame, removal of the dead bolt housing from the door, or damage to the dead bolt housing itself by removal of a portion of the dead bolt housing or removal of the dead bolt from the housing.

Accordingly, a need exists for an alarm switch assembly that secures a barrier within a barrier frame without the disadvantages of the prior art.

SUMMARY OF THE INVENTION

An object of the present invention is, therefore, to provide a unitary plunger-operated alarm switch assembly that provides without visual inspection of the assembly an indication of whether a barrier is in a secure position or the alarm switch assembly has been tampered with.

Another object of the invention is to provide such a switch assembly that is installed entirely on either the barrier or the barrier frame.

A further object of the invention is to provide such a switch assembly that is relatively inexpensive to install.

Still another object of the invention is to provide such a switch assembly that includes a magnet and a reed switch that are unsusceptible to misalignment.

A preferred embodiment of the alarm switch assembly includes a plunger housing that is matable to a switch plate. The plunger housing supports a movable plunger carrying within it a permanent magnet that produces a magnetic field. The switch plate supports a magnetically actuatable reed switch positioned in predetermined relative alignment to a guide path of the plunger when the plunger housing and the switch plate are matably fitted together. The plunger is movable relative to the plunger housing between an alarm position, in which the plunger allows movement of the barrier relative to the barrier-frame, and a secure position, in which the plunger secures the barrier against movement relative to the barrier-frame. Whenever the plunger is in the alarm position, i.e., fully retracted into the housing, the magnetic field and the reed switch interact to cause the reed switch to provide an alarm switching condition. Whenever the plunger is in the secure position, i.e., fully extended into the door frame, the magnetic field and the reed switch interact to cause the reed switch to provide a secure switching condition.

The relative alignment of the reed switch and the guide path of the plunger provides a tamper indication feature because misalignment of the reed switch and the guide path changes the interaction between the magnetic field and the reed switch. The change in magnetic field interaction causes the reed switch to provide the alarm switching condition indicating a compromise to the reliability of the assembly.

In another embodiment, the plunger-operated alarm switch assembly comprises a one-piece unitary housing supporting the movable plunger and the magnetically actuatable reed switch.

Additional objects and advantages of the present invention will be apparent from the following detailed description of the preferred embodiments which proceeds with reference to the accompanying drawings.

BRIEF DESCRIPTION OF THE DRAWINGS

FIG. 7 is a front isometric view of the two components of the two-piece alarm switch assembly of FIG. 1 showing the underside of the plunger housing and the reed switch mounted on the switch plate.

FIG. 9 is a top, front isometric view of another embodiment of the alarm switch assembly comprising a one-piece housing supporting the plunger and the reed switch.

DETAILED DESCRIPTION OF THE PREFERRED EMBODIMENTS

Figure 1:
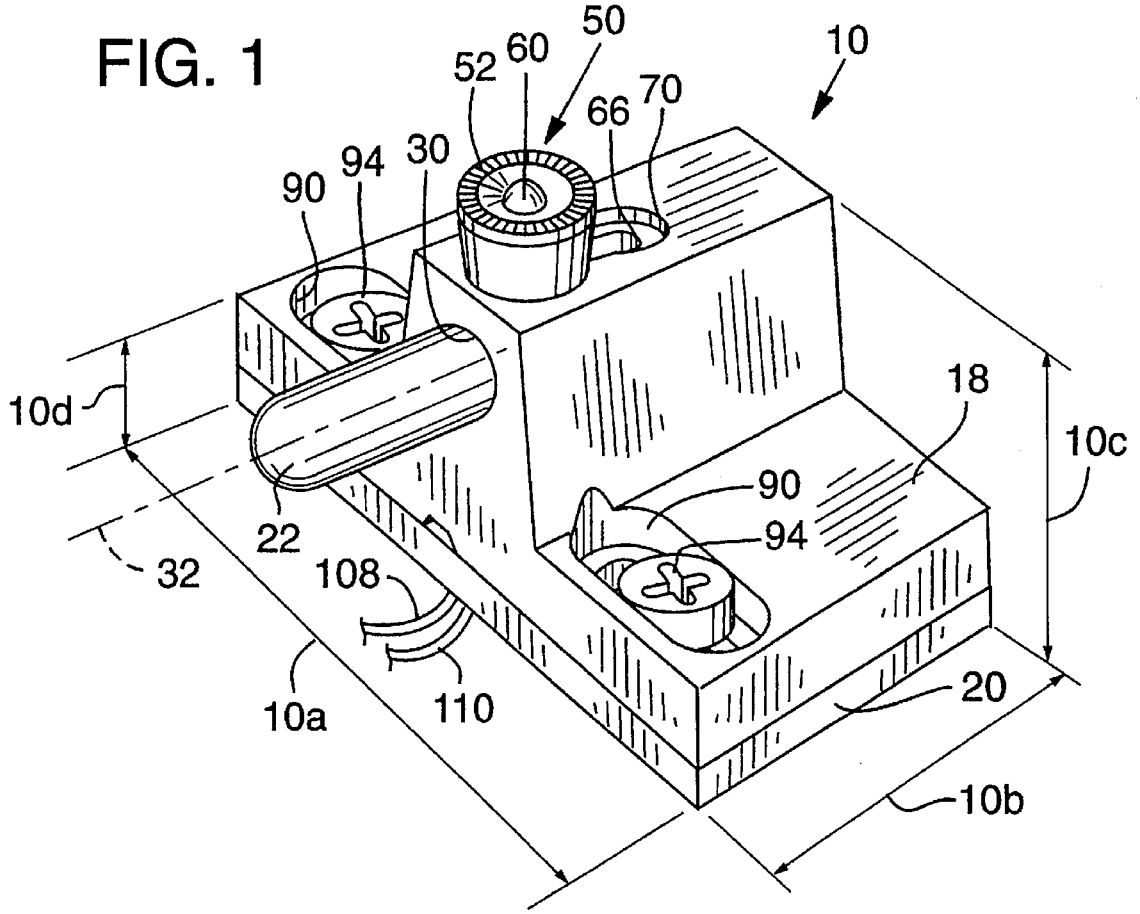
FIG. 1 is a top, front isometric view of a two-piece alarm switch assembly of the present invention showing the plunger housing and the switch plate aligned with each other in a typical mounting position.
Figure 2A:
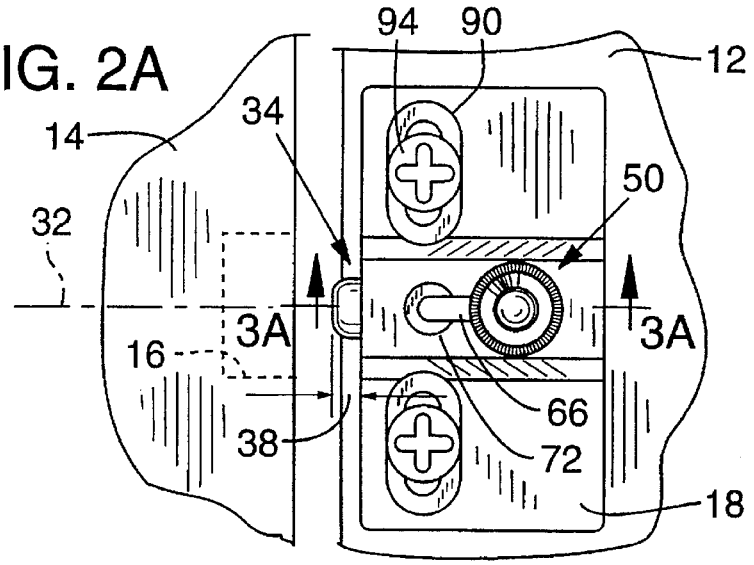
FIGS. 2A, 2B, and 2C are top plan fragmentary views of the alarm switch assembly of FIG. 1 installed on a barrier frame showing, respectively, the assembly secured to the frame and the plunger in a retracted position allowing a barrier to move relative to the barrier frame, the assembly detached from the frame due to tampering and thereby allowing the barrier to move relative to the barrier frame, and the assembly secured to the frame and the plunger in an extended position securing the barrier against movement relative to the barrier frame.
Figure 5:
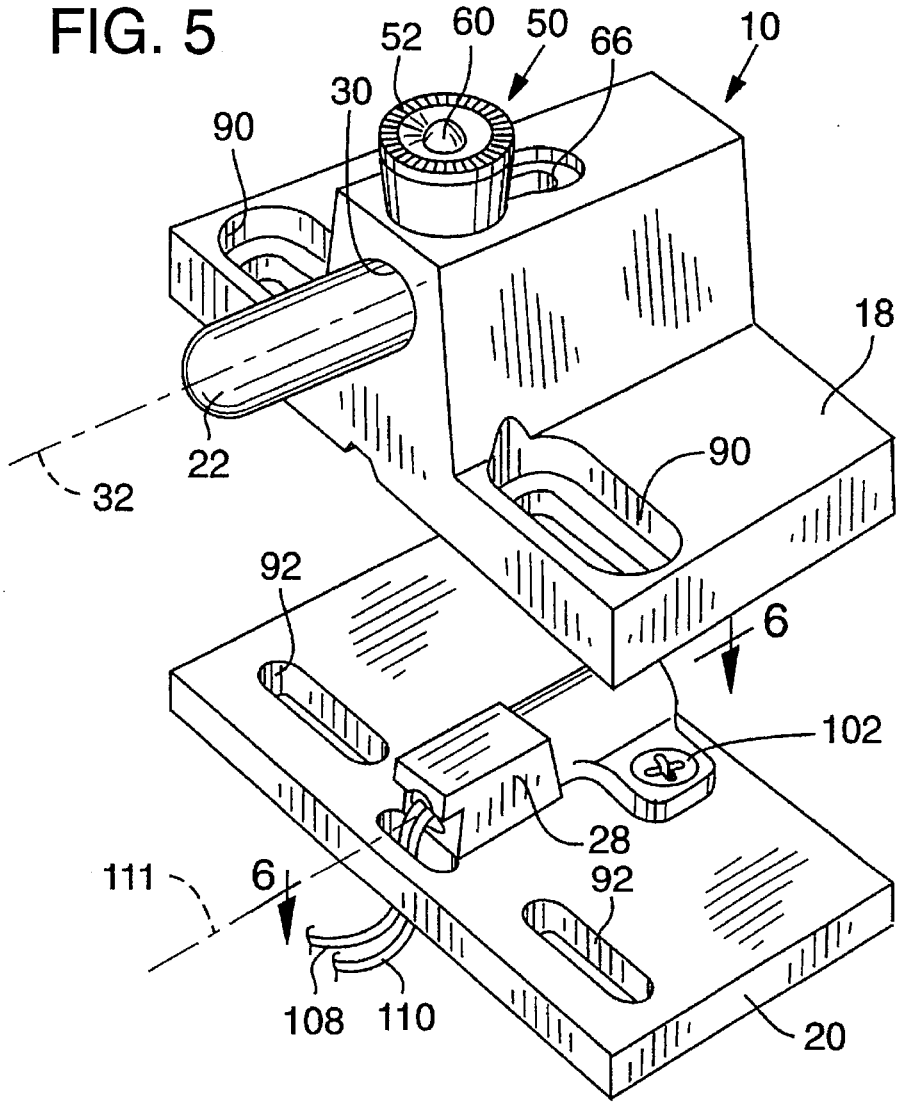
FIG. 5 is a top, front isometric view of the alarm switch assembly of FIG. 1 showing the plunger housing and the switch plate separated from each other.

FIG. 1 shows a preferred two-piece unitary plunger-operated alarm switch assembly 10 of the present invention mounted on a barrier frame 12 (FIGS. 2A, 2B, and 2C) that supports a movable barrier 14, such as a sliding door or window, having an aperture 16 (shown as a dashed line). Alarm switch assembly 10 includes a plunger housing 18 that is matable to a switch plate 20. Plunger housing 18 supports an elongate, closed, movable plunger 22 having a longitudinal axis carrying within it a permanent magnet 24 having an axis that substantially coincides with the longitudinal axis of the plunger 22. The permanent magnet 24 (FIGS. 8A, 8B, and 8C) produces magnetic field lines 26. Switch plate 20 supports a magnetically actuatable reed switch 28 (FIG. 5). In a preferred embodiment, alarm switch assembly 10 is mounted on a threshold, floor portion of a patio door frame 12 and plunger 22 extends from housing 18 into an aperture 16 of a patio sliding door 14 supported for sliding movement within frame 12. Assembly 10 may also be mounted on an upper or side portion of a door frame or a window frame.

Plunger housing 18, switch plate 20, and movable plunger 22 can be manufactured of a durable high density plastic but preferably are manufactured of an inexpensive, easily cast, strong, non-ferrous metal such as aluminum. Alarm switch assembly 10 typically is 5.5 centimeters measured along length 10*a*, 3.0 centimeters measured along width 10*b*, 2.5 centimeters measured along total height 10*c*, and 1.0 centimeter measured along height 10*d*. An alarm switch assembly having smaller dimensions may be installed on window frames.

Figure 2B:
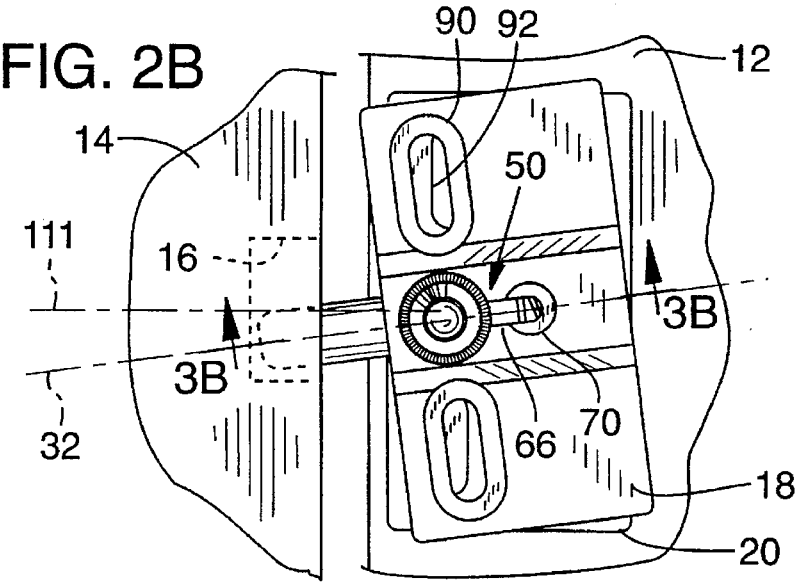
Figure 2C:
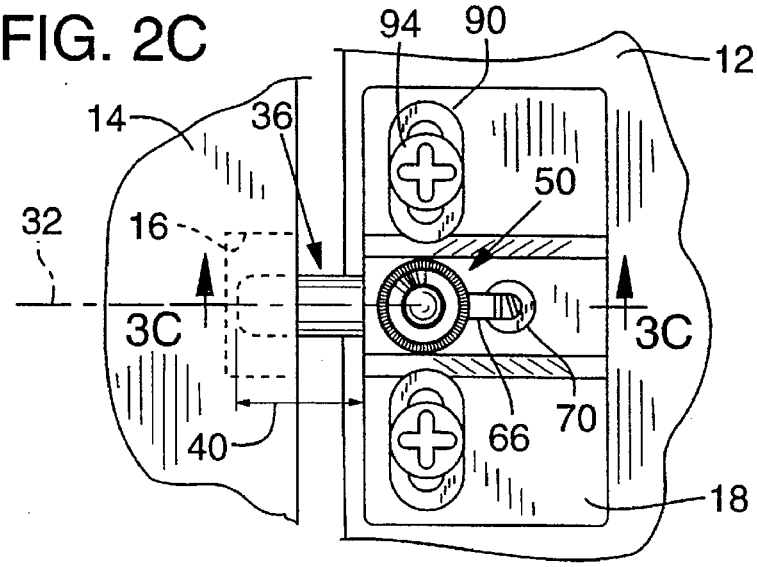
Figure 3A:
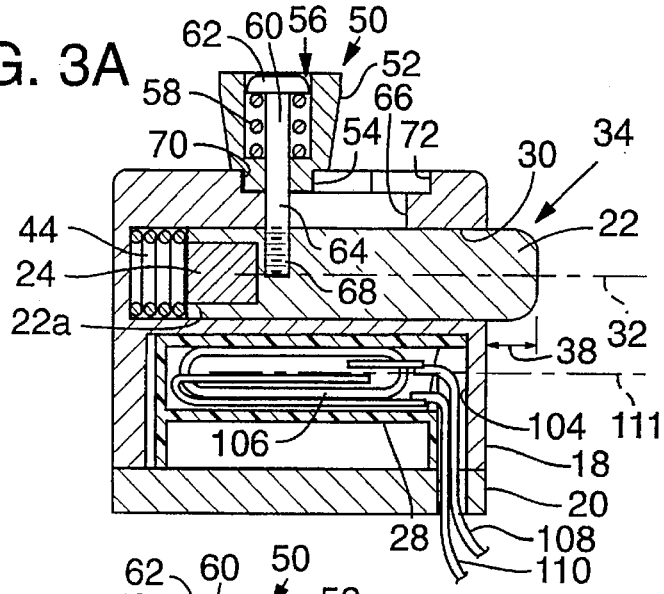
FIGS. 3A, 3B, and 3C are sectional views taken along lines 3A—3A, 3B—3B, and 3C—3C of, respectively, FIGS. 2A, 2B, and 2C.
Figure 3B:
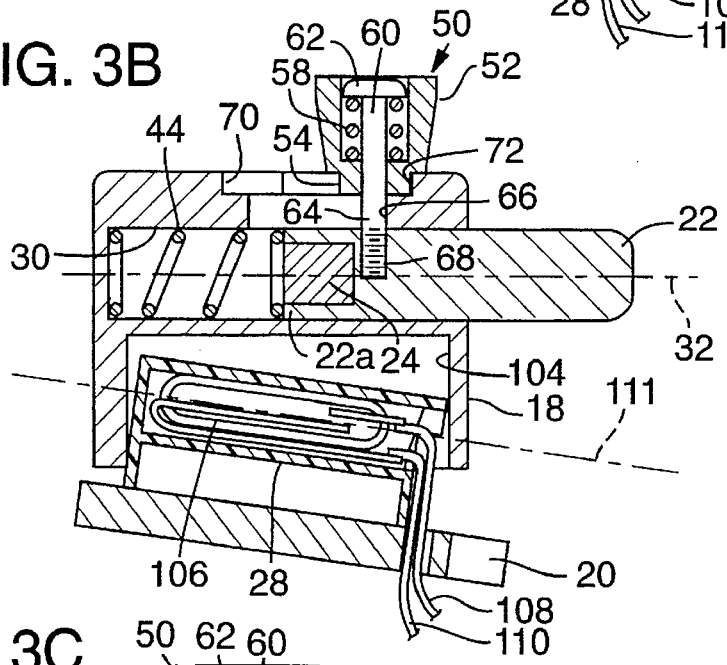
Figure 3C:
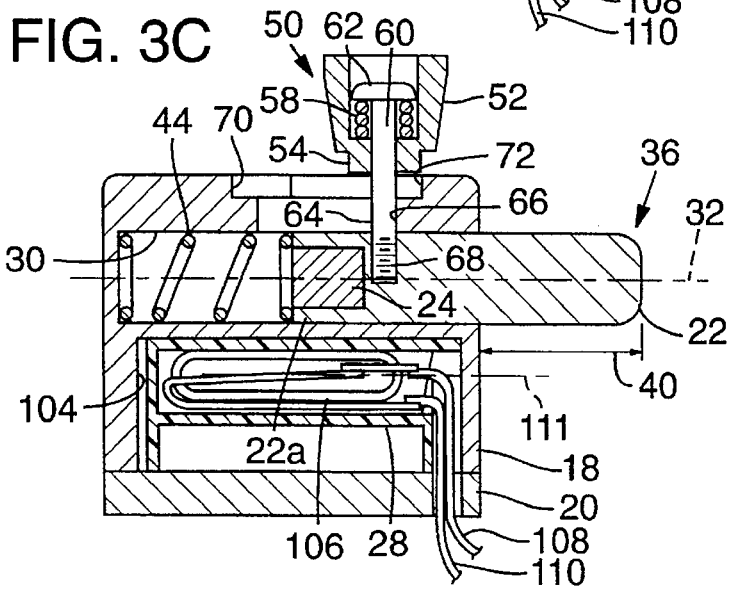

Plunger housing 18 includes an interior cavity 30 (FIGS. 3A, 3B, and 3C) in which movable plunger 22 is supported for sliding movement along a guide path 32 between a first position 34 (FIGS. 2A and 3A) and a second position 36 (FIGS. 2C and 3C). Plunger 22 is movable along a travel path that substantially coincides with longitudinal axis of plunger 22. Guide path 32 represents the nominal travel path of plunger 22 when plunger housing 18 and switch plate 20 are matingly secured together. First position 34 typically is an unsecured position in which plunger 22 is retracted rearwardly into interior cavity 30 along guide path 32 and extends a retracted distance 38 (preferably 0.7 centimeter) from interior cavity 30. In this position plunger 22 preferably does not extend into aperture 16 of barrier 14 thereby allowing barrier 14 to move relative to barrier frame 12.

Second position 36 typically is a secure position in which plunger 22 extends outwardly an extended distance 40 (preferably 1.7 centimeters) from interior cavity 30 along guide path 32 and into aperture 16 of barrier frame 12 (when barrier 14 is in the closed position relative to barrier frame 12). In second position 36, plunger 22 prevents barrier 14 from moving relative to barrier frame 12. Interior cavity 30 typically includes a spring 44 that nominally biases plunger 22 into extended secure position 36.

Plunger 22 preferably includes a lock 50 that is operable to lock plunger 22 in first position 34 or in second position 36. Lock 50 comprises a collar 52 (FIG. 3A) having an extended base 54 and a central depression 56 containing a coil spring 58 through which a central pin 60 extends. Pin 60 includes an end cap 62 positioned in depression 56 and a threaded end 64 extending through a slot 66 in plunger housing 18 and secured within a threaded aperture 68 in plunger 22. Spring 58 biases collar 52 downwardly from end cap 62 toward threaded end 64, thereby biasing extended base 54 into a first recess 70 or a second recess 72 of slot 66 when plunger 22 is positioned in, respectively, first position 34 or second position 36. To remove plunger 22 from the locked position (FIG. 3A), a user pulls collar 52 upwardly to compress spring 58 (FIG. 3C) and thereby remove base 54 from recess 70 or 72 and allow free movement of plunger 20 along guide path 32.

With particular reference to FIGS. 1 and 5, plunger housing 18 includes a pair of slots 90 aligned with a pair of corresponding slots 92 in switch plate 20 when plunger housing 18 and switch plate 20 are aligned and matably fitted together. A pair of fasteners 94, preferably screws, pass through aligned pairs of slots 90 and 92 and secure plunger housing 18 to switch plate 20, and preferably secure plunger housing 18 and switch plate 20 to barrier frame 12. Fasteners 94 may also be rivets or other fastening devices. Removal of or tampering with fasteners 94 will result in a separation of or a misalignment between plunger housing 18 and switch plate 20. In a preferred embodiment, smooth contacting surfaces 18*a* and 20*a* of, respectively, housing 18 and switch plate 20 facilitate ease of separation or misalignment and thereby facilitate detection of minor tampering with or damage to assembly 10.

Figure 6:
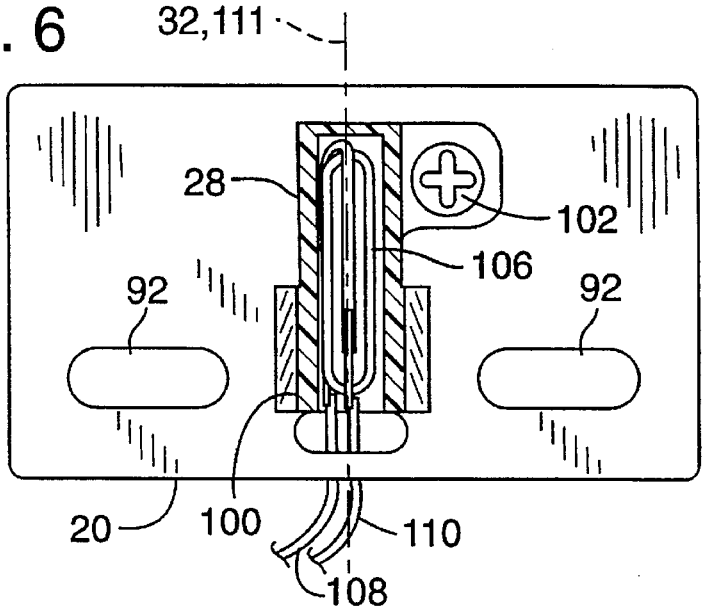
FIG. 6 is a top plan view of the switch plate of FIG. 1 including a cut away view taken along lines 6—6 of FIG. 5 showing the reed switch mounted on the switch plate.

FIG. 6 shows a partly cut away top view of reed switch 28 that includes a switch housing 100 secured to switch plate 20 by a fastener 102. Switch housing 100 is contained within a switch cavity 104 (FIG. 7) of plunger housing 18 when plunger housing 18 and switch plate 20 are aligned and matably assembled together. In assembled form, reed switch 28 is positioned in a predetermined relative alignment to plunger 22 and its guide path 32. Switch housing 100 includes a magnetically actuatable switch 106 to which a first lead wire 108 and a second lead wire 110 are connected. Switch 106 has a central longitudinal axis 111, which in the plane of FIG. 6 is coincident to, and in a plane perpendicular to FIG. 6 is parallel to, guidepath 32, and, thus, the axis of permanent magnet 24. Lead wires 108 and 110 preferably are electrically connected to a central alarm system (not shown).

Figure 4:
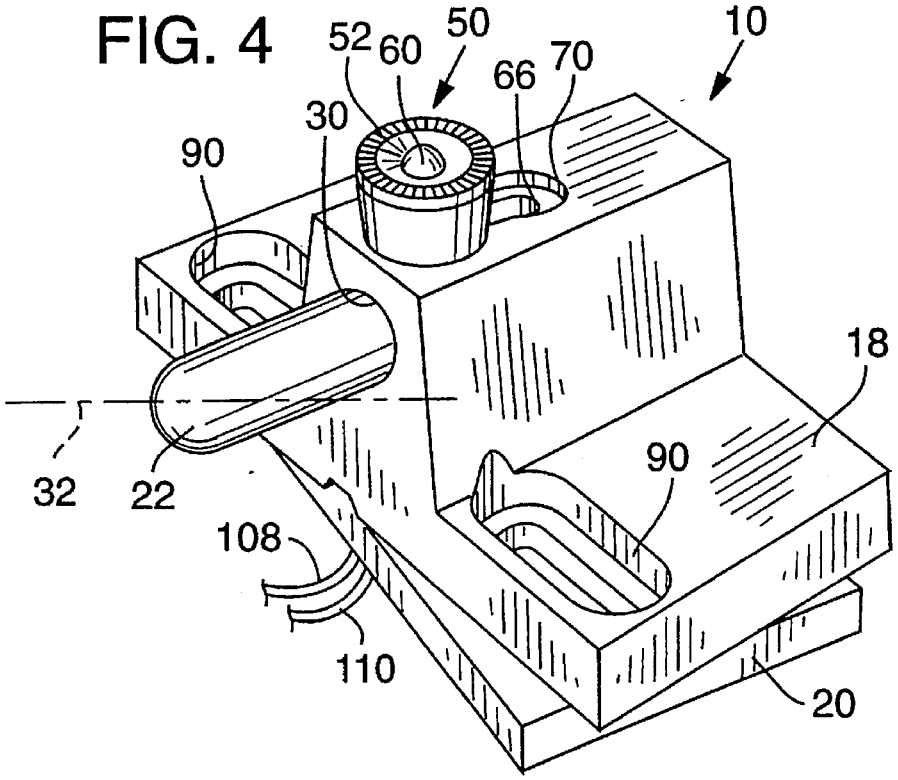
FIG. 4 is a top, front isometric view of the alarm switch assembly of FIG. 1 showing the plunger housing and the switch plate misaligned from each other.

Permanent magnet 24 (FIGS. 3A, 3B, and 3C) is preferably positioned within plunger end 22*a* adjacent spring 44. When plunger 22 is retracted into first position 34 (FIGS. 3A), there is a nominally weak interaction 26*a* (FIG. 8A) between magnetic field lines 26 and magnetically actuatable switch 106, causing switch 106 to provide a first switching condition 112. First switching condition 112 is an electrical "open circuit" having no electrical connection between wires 108 and 110. Weak magnetic field interaction 26*a* also occurs when plunger housing 18 and switch plate 20 are separated from each other (FIG. 5), misaligned with respect to each other (FIG. 4), or partly separated and misaligned with respect to each other (FIGS. 2B and 3B). In these cases, weak magnetic field interaction 26a (FIG. 8B) results from a change in the predetermined relative alignment between longitudinal axis 111 of switch 106 and the axis of the permanent magnet 24 in the plunger 22, i.e., plunger 22 is misaligned from guide path 32, and causes switch 106 to provide first switching condition 112.

In contrast, when plunger 22 is extended into second position 36 (FIG. 3C), there is a strong interaction 26b (FIG. 8C) between magnetic field lines 26 and magnetically actuatable switch 106, causing switch 106 to provide a second switching condition 114. Second switching condition 114 is an electrical "closed circuit" having an electrical connection between wires 108 and 110.

An indicator (not shown) typically is electrically connected to reed switch 28 and indicates an alarm signal when reed switch 28 provides first switching condition 112 and a secure signal when reed switch 28 provides second switching condition 114. The indicator may be one of any known indicators such as an LED display, alarm light, or aural alarm signal.

Figure 8A:
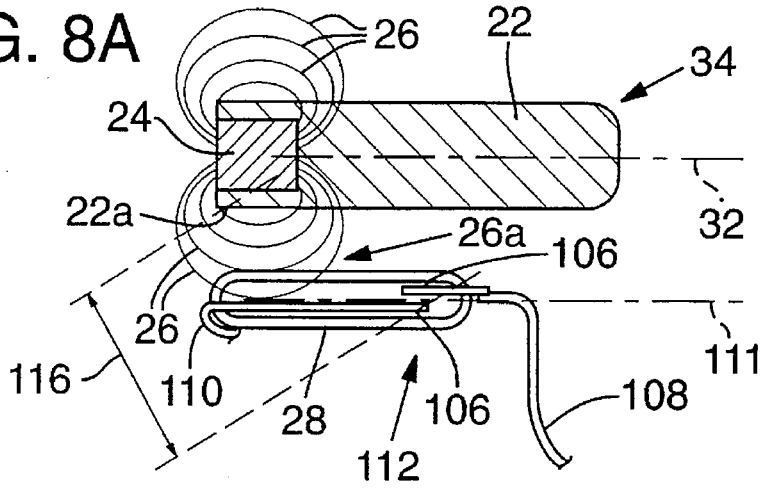
FIGS. 8A, 8B, and 8C are component diagrams of the plunger and reed switch of FIGS. 3A, 3B, and 3C showing, respectively, a weak magnetic field interaction resulting from positioning of the plunger in the alarm position, a weak magnetic field interaction resulting from misalignment between the plunger housing and reed switch, and a strong magnetic field interaction resulting from positioning of the plunger in the secure position.
Figure 8B:
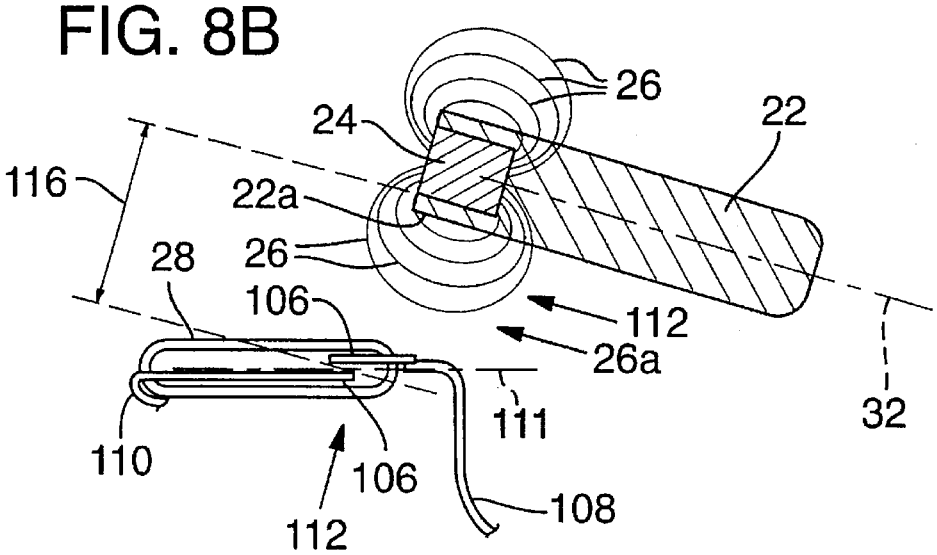
Figure 8C:
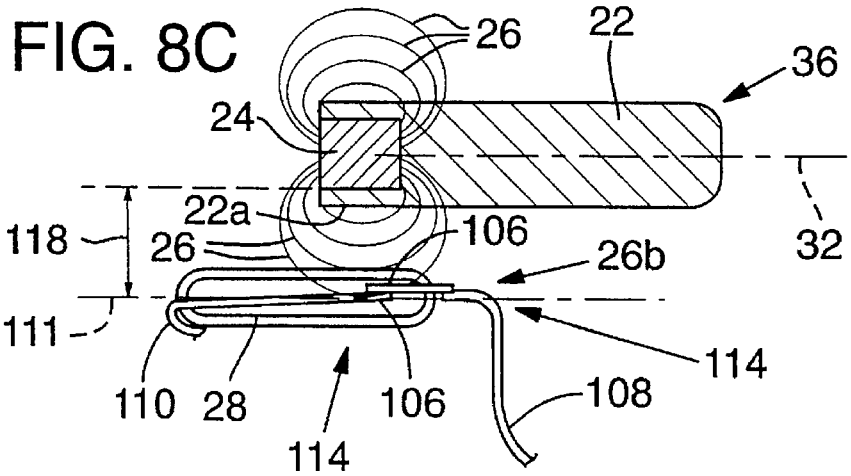

Weak interaction 26a between magnetic field lines 26 and switch 106 is insufficient to force closure of nominally open switch 106 and results from an insufficient activation distance 116 (FIGS. 8A and 8B). In contrast, strong interaction 26b between magnetic field lines 26 and switch 106 is sufficient to force closure of switch 106 and results from a sufficient activation distance 118 (FIG. 8C). In the preferred embodiments, insufficient activation distance 116 is greater than sufficient activation distance 118. Skilled persons will understand, however, that during manufacture permanent magnet 24 can be positioned at any location within plunger 22 so that the sufficient activation distance is greater than the insufficient activation distance, or a nominally closed switch can be provided so that a strong magnetic field interaction is required to open the switch.

FIG. 9 shows another embodiment of an alarm switch assembly 120 comprising a unitary housing 122 supporting within it plunger 22 and reed switch 28 in predetermined relative alignment with a guide path 32 of plunger 22. Reed switch 28 in alarm switch assembly 120 is activated into secure switching condition 114 when plunger 22 is in extended position 36. Reed switch 28 is activated into alarm switching condition 112 when plunger 22 is in retracted position 34 or when the predetermined relative alignment between reed switch 28 and guide path 32 changes. The predetermined relative alignment may change as a result of tampering with or breaking of unitary housing 122.

It will be obvious that many changes may be made to the above-described details of the preferred embodiments of the invention without departing from the underlying principles thereof. The scope of the present invention should, therefore, be determined only by the following claims.

I claim:

1. A tamper-resistant alarm lock switch assembly to prevent movement of a movable barrier, comprising:

a plunger housing supporting a movable elongate plunger having a longitudinal axis and a permanent magnet having an axis that substantially coincides with the longitudinal axis of the plunger and that produces a magnetic field, the plunger being movable relative to the plunger housing along a guide path; and a switch plate supporting a magnetically actuatable reed switch having a longitudinal axis and matable to the plunger housing to form a unitary article, the reed switch being secured to the switch plate in a predetermined relative alignment to the guide path of the plunger so that the longitudinal axis of the reed switch is substantially parallel to the longitudinal axis of the plunger, the plunger being movable between a first position in which the magnetic field and the reed switch interact to cause the reed switch to assume a first switching condition and a second position in which the magnetic field and the reed switch interact to cause the reed switch to assume a second switching condition;

the plunger and reed switch being constructed and arranged so that the reed switch assumes the first switching condition when the longitudinal axis of the plunger is transversely aligned to the longitudinal axis of the reed switch.

2. The assembly of claim 1 in which the plunger housing has an interior cavity in which the plunger is supported for sliding movement along the guide path, and in which the reed switch is supported on the switch plate so that when the plunger housing and the switch plate are assembled as a unitary article, the reed switch is contained within the plunger housing.

3. The assembly of claim 1 in which the permanent magnet is positioned at a predetermined place within the plunger so that the reed switch nominally provides the first switching condition.

4. The assembly of claim 1, further comprising fasteners that secure together the plunger housing and the switch plate.

5. The assembly of claim 1, further comprising a spring that biases the plunger into the second position.

6. The assembly of claim 1, further comprising a lock that is operable to secure the plunger in the second position.

7. In a tamper-resistant alarm lock switch assembly to that prevents movement of a movable barrier, the switch assembly including a plunger housing supporting a movable elongate plunger that has a longitudinal axis and that moves relative to the plunger housing along a guide path between first and second positions, a method of actuating a reed switch having a longitudinal axis in response to movement of the plunger or tampering with the alarm lock switch assembly, comprising:

providing within the plunger a permanent magnet having an axis that substantially coincides with the longitudinal axis of the plunger and that produces a magnetic field; and assembling a switch plate supporting a magnetically actuatable reed switch and the plunger housing to form a unitary article, the reed switch being secured to the switch plate in a predetermined relative alignment to the guide path of the plunger so that the longitudinal axis of the reed switch is substantially parallel to the longitudinal axis of the plunger, the magnetic field of the permanent magnet actuates the reed switch into a first switching condition when the plunger is either in the first position or when the longitudinal axis of the reed switch is transversely aligned to the longitudinal axis of the plunger, and actuates the reed switch into a second switching condition when the plunger is in the second position.

8. The method of claim 7, further comprising producing an alarm signal when the reed switch is actuated into the first switching condition.

9. The method of claim 7, further comprising producing a secure signal when the reed switch is actuated into the second switching condition.

10. The method of claim 7 in which the plunger housing has an interior cavity where the plunger is supported for sliding movement along the guide path, and in which the reed switch is supported on the switch plate so that when the plunger housing and the switch plate are assembled as a unitary article, the reed switch is contained within the plunger housing.

11. The method of claim 7 in which the permanent magnet is positioned at a predetermined place within the plunger so that the reed switch nominally provides the first switching condition.

12. The method of claim 7 in which fasteners secure together the plunger housing and the switch plate.

13. The method of claim 7 in which a spring biases the plunger into the second position.

14. A tamper-resistant alarm lock switch to prevent movement of a movable barrier comprising:

an alarm lock switch housing including a reed switch cavity and a plunger having a longitudinal axis and movable along a guide path the plunger supported by the alarm lock switch housing to be moved along the guide path between a secure position and an alarm position, the plunger including a permanent magnet having an axis that substantially coincides with the longitudinal axis of the plunger and that produces a magnetic field; and a magnetically actuatable reed having a longitudinal axis switch positioned in the reed switch cavity of the alarm lock switch housing and in a predetermined relative alignment to the guide path so that the longitudinal axis of the reed switch is substantially parallel to the longitudinal axis of the plunger, the reed switch actuated into a secure switching condition by the magnetic field of the permanent magnet when the plunger is in the secure position and actuated into an alarm switching condition by the magnetic field of the permanent magnet either when the plunger is in the alarm position or when the longitudinal axis of the reed switch is transversely aligned to the longitudinal axis of the plunger.

15. The switch of claim 14, further comprising an alarm indicator operatively connected to the reed switch and producing a secure signal when the reed switch is in the secure switching condition.

16. The switch of claim 14, further comprising an alarm indicator operatively connected to the reed switch and producing an alarm signal when the reed switch is in the alarm switching condition.

17. The switch of claim 14, further comprising a spring that biases the plunger into the secure position.

18. The switch of claim 14 in which the plunger includes a lock operable to secure the plunger in the secure position.

* * * * *